US011384536B1

(12) United States Patent
Gulbrandsen et al.

(10) Patent No.: US 11,384,536 B1
(45) Date of Patent: Jul. 12, 2022

(54) CEILING GRID HANGER HOLES

(71) Applicant: USG Interiors, LLC, Chicago, IL (US)

(72) Inventors: Peder J. Gulbrandsen, Aurora, IL (US); Nathan Mathiot, Lake Zurich, IL (US); Michael P. O'Donnell, Modesto, CA (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 17/227,891

(22) Filed: Apr. 12, 2021

(51) Int. Cl.
*E04B 9/06* (2006.01)
*E04C 3/04* (2006.01)

(52) U.S. Cl.
CPC ..... *E04B 9/068* (2013.01); *E04C 3/04* (2013.01); *E04C 2003/046* (2013.01); *E04C 2003/0408* (2013.01)

(58) Field of Classification Search
CPC .... E04B 9/068; E04C 3/04; E04C 2003/0408; E04C 2003/046
See application file for complete search history.

(56) References Cited

U.S. PATENT DOCUMENTS 3,084,401 A * 4/1963 Findlay ..... E04B 9/122 52/506.07
3,189,139 A * 6/1965 Znamirowski ..... E04B 9/068 52/506.07
3,369,332 A * 2/1968 Harlan ..... E04B 9/068 52/98
3,370,301 A * 2/1968 Harlan ..... E04B 9/122 52/664
3,589,089 A * 6/1971 Kedel ..... E04C 3/09 52/506.07
3,640,557 A * 2/1972 Nute, Jr. ..... E04B 9/10 403/287
3,722,167 A * 3/1973 Rousey ..... E04B 9/10 52/506.07
3,965,632 A * 6/1976 Rousey ..... E04B 9/068 52/506.07
3,979,874 A * 9/1976 Cubbier, Jr. ..... E04B 9/122 52/506.07
4,317,318 A * 3/1982 Sauer ..... E04B 9/122 52/506.06
4,614,072 A * 9/1986 Price ..... E04B 9/16 411/433
4,785,595 A * 11/1988 Dunn ..... E04B 9/08 52/506.07
4,785,603 A * 11/1988 Platt ..... E04B 9/122 52/506.07
4,794,745 A * 1/1989 Platt ..... E04B 9/068 52/506.07

(Continued)

OTHER PUBLICATIONS

USG engineering drawing showing prior art product, dated Jan. 22, 1996.

*Primary Examiner* — James M Ference
(74) *Attorney, Agent, or Firm* — Pearne & Gordon LLP

(57) ABSTRACT

A main tee for a suspended ceiling formed of metal sheet and having an upper reinforcing bulb, a lower flange and a web between the bulb and flange, the web having evenly spaced, generally vertical cross tee receiving slots along a length of the tee and a series of suspension wire receiving holes along the length of the tee, the lowermost edges of the holes being above a highest extremity of the cross tee slots.

5 Claims, 2 Drawing Sheets

(56) References Cited

U.S. PATENT DOCUMENTS 4,827,681 A * 5/1989 Platt ..... E04B 9/122 52/506.07
5,044,138 A * 9/1991 Zaccardelli ..... E04B 9/122 52/506.07
5,517,796 A * 5/1996 Koski ..... E04B 9/122 52/506.07
5,687,525 A * 11/1997 Koski ..... E04B 9/122 52/506.07
5,761,868 A * 6/1998 LaLonde ..... E04B 9/122 52/506.07
5,761,869 A * 6/1998 Tinen ..... E04B 9/068 52/762
6,041,564 A * 3/2000 Shirey ..... B21D 39/034 29/21.1
6,047,511 A * 4/2000 Lehane ..... E04B 9/10 29/521
6,178,712 B1 * 1/2001 Sauer ..... E04B 9/122 52/506.07
6,477,815 B2 * 11/2002 Paul ..... E04B 9/122 52/506.07
6,526,716 B2 * 3/2003 Paul ..... E04B 9/127 52/506.07
7,231,746 B2 * 6/2007 Bodnar ..... E04C 2/384 52/649.3
7,516,585 B2 * 4/2009 Lehane, Jr ..... E04B 9/068 52/506.07
7,574,838 B2 * 8/2009 Maisch ..... E04B 9/068 52/506.07
7,578,107 B2 * 8/2009 Platt ..... E04B 9/30 52/506.09
D618,826 S * 6/2010 Lehane, Jr. ..... D25/164
7,849,652 B2 * 12/2010 Lehane ..... E04B 9/122 52/506.07
7,930,864 B2 * 4/2011 Wendt ..... E04B 9/30 52/712
D641,500 S * 7/2011 Lehane, Jr. ..... D25/164
8,381,486 B1 * 2/2013 Lehane, Jr. ..... E04B 9/122 52/506.07
8,397,462 B2 * 3/2013 Gulbrandsen ..... E04B 9/067 52/506.07
8,590,248 B2 * 11/2013 Lehane, Jr. ..... E04B 9/241 52/506.07
8,898,986 B1 * 12/2014 Underkofler ..... E04B 9/125 52/506.07
9,416,536 B1 * 8/2016 Lehane ..... E04B 9/183
9,598,864 B1 * 3/2017 Hulka ..... E04B 9/16
9,637,918 B1 * 5/2017 Carbajal ..... E04B 9/127
9,777,478 B1 * 10/2017 Hulka ..... E04B 9/001
10,011,987 B1 * 7/2018 Lehane ..... E04B 9/068
D829,345 S * 9/2018 Czyzewicz ..... D25/58
10,106,982 B2 * 10/2018 Corpolongo ..... F16B 7/18
10,316,514 B2 * 6/2019 Czyzewicz ..... E04B 9/067
2007/0125038 A1 * 6/2007 Lehane ..... E04B 9/068 52/506.07
2008/0148668 A1 * 6/2008 Jahn ..... E04B 9/068 52/506.07
2008/0245018 A1 * 10/2008 Miller ..... E04B 9/061 52/506.07
2009/0158684 A1 * 6/2009 Lehane, Jr. ..... E04B 9/068 52/506.07
2010/0005747 A1 * 1/2010 Tedesco ..... E04B 9/122 52/506.08
2011/0131913 A1 * 6/2011 Lehane, Jr. ..... E04B 9/122 72/336
2011/0146184 A1 * 6/2011 Lehane, Jr. ..... E04B 9/122 52/506.07
2011/0146194 A1 * 6/2011 Tedesco ..... E04B 9/30 52/665
2012/0304574 A1 * 12/2012 Gulbrandsen ..... E04B 9/067 52/506.07
2014/0352249 A1 * 12/2014 Jankovec ..... E04B 9/127 52/665
2015/0337532 A1 * 11/2015 Cipriani ..... E04B 9/067 52/848
2016/0053488 A1 * 2/2016 Lehane ..... E04B 9/067 52/506.07
2018/0135300 A1 * 5/2018 Czyzewicz ..... E04B 9/068
2020/0318350 A1 * 10/2020 Wilkens ..... E04B 9/127

* cited by examiner

CEILING GRID HANGER HOLES

BACKGROUND OF THE INVENTION

The invention relates to improvements in grid tees and in particular to suspension holes for such articles.

SUMMARY OF THE INVENTION

As disclosed, the location and form of suspension holes, typically in main tees, are arranged to facilitate erection of a grid and in some instances improve its load carrying capacity. As conventional, the suspension holes are located in the vertical, central web extending between an upper reinforcing bulb and a lower panel supporting flange. Holes closest to cross tee slots in the web are horizontally elongated to facilitate threading assembly of hanger wire therethrough, particularly in poorly illuminated conditions. Additionally, the holes are spaced horizontally and vertically away from the cross tee slot than has been customary to enable an installer to more easily finger guide a connector into the slot. Still further, vertical displacement of the hanger holes from the cross tee slots minimizes the risk that a cross tee connector sliding along the main tee during installation will intersect a hanger hole and confuse the installer, thinking the connector is aligned with a cross tee slot or will be obstructed by a hanger wire. Advantageously, the holes are centered one inch above the grid face, eliminating measurements in fractions when establishing the plane of the grid face.

The foregoing improvements in the arrangement of the main tee suspension holes can improve the productivity of an installer. This improvement can drive sales ultimately to the manufacturer.

DESCRIPTION OF THE PREFERRED EMBODIMENT

Figure 1:
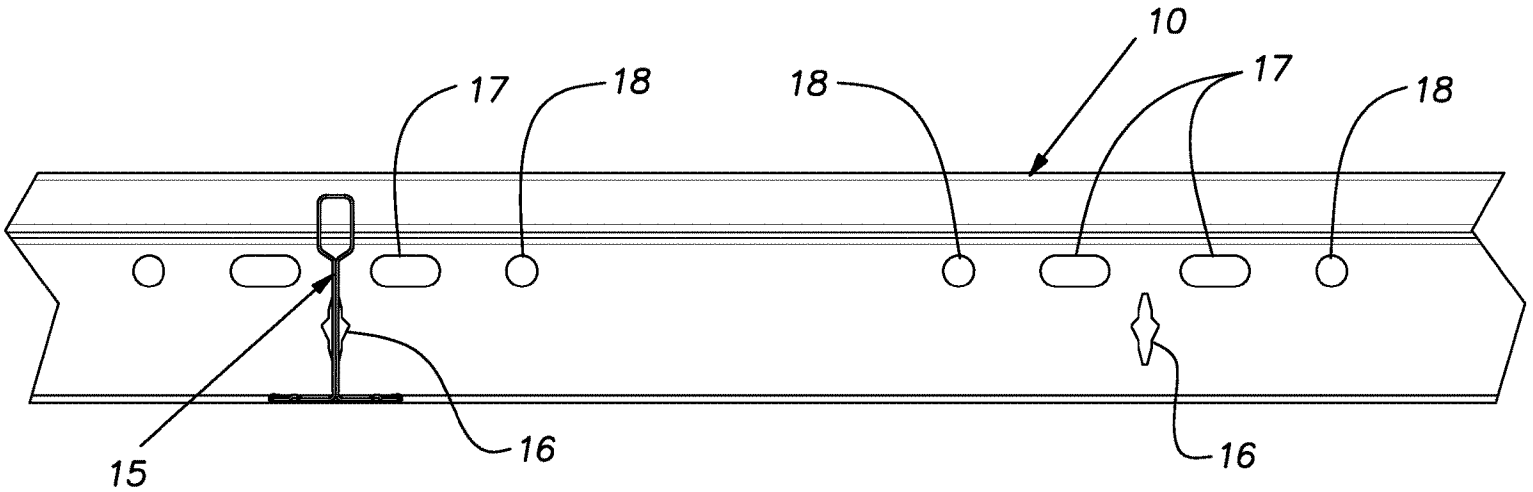
FIG. 1 is a side view of a portion of the length of the inventive grid main tee.

A main tee or runner 10, typically supplied in 12 foot lengths, (3,600 mm or industry metric equivalent) is used with cross tees 15 (FIG. 1) to form a suspended ceiling grid. The grid supports rectangular panels, lights, HVAC diffusers and other utilities. As is traditional, the main tees 10 are suspended from superstructure with steel hanger wire, typically 12 gauge. As shown in FIG. 2, the tee 10 made of sheet metal has an upper reinforcing bulb 11, double layer web 12 and lower flange 13 that include a cap strip 14.

The illustrated main tee 10 has cross tee receiving slots 16 conventionally spaced 6 inches (150 mm) apart, along the length of the tee.

Situated symmetrically from a cross tee slot 16 are hanger holes 17, 18 in the web 12. Holes 17 adjacent a slot 16 are oblong while outlying holes 18 are round. The width of the holes 17 is preferably the same as the diameter of the holes 18 (for instance 0.219 in.; 5.6 mm) and the elevation from the tee face, provided by the cap strip 14, of both the oblong and round holes 17, 18 is the same.

Figure 2:
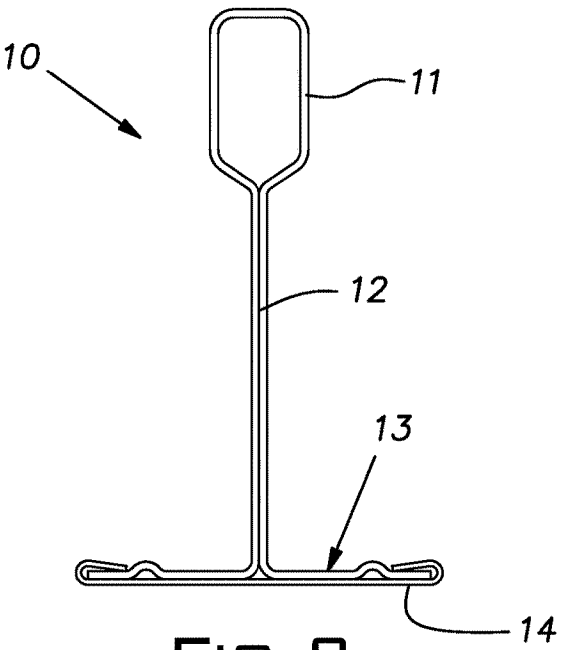
FIG. 2 is a cross-section of the grid tee of FIG. 1.

Inspection of FIG. 1 shows that the lowermost edges of both the oblong and round holes 17, 18 is above the upper extremity of the cross tee slot 16. This construction facilitates assembly of the cross tee connectors in the slots 16. With a hanger wire in either holes 17 or 18, the risk that a cross tee connector will be obstructed by a hanger wire in any of the adjacent holes 17, 18 when the cross tee assembly motion includes a sideways or lateral component such as when a cross tee end is slid over the flange 13 of the main tee 10.

Installers favor using the oblong holes 17, particularly at low illumination sites since it is easier to thread a hanger wire through it than the round hole 18, the area of the oblong hole being larger.

A hanger wire in an oblong hole 17 can be shifted horizontally in the hole away from the slot 16 with low force. When an installer uses a finger of one hand on the back side of a main tee 10 to guide a cross tee end connector to a slot 16 by instinctive knowledge of the location of the installer's finger and to feel the connector in the slot, he can displace the hanger wire in the oblong hole 17 for greater finger access to the slot 16.

Figure 3:
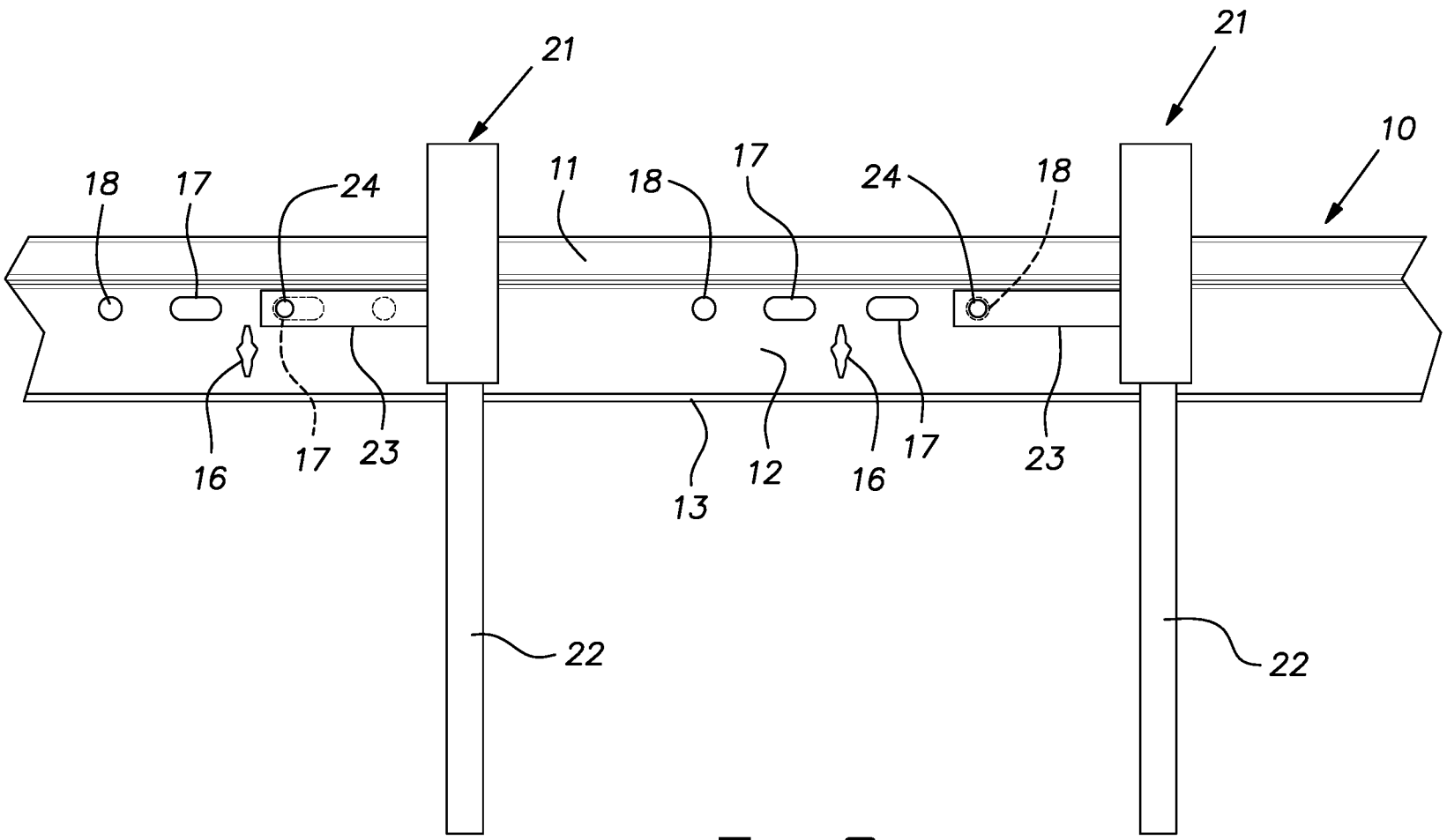
FIG. 3 is a diagrammatic plan view of a manual punch tool illustrated in two places.

Referring to FIG. 3, a manually operated cross tee slot punch 21 is diagrammatically illustrated. The punch 21 known in the art, operates in a manner analogous to a manual paper punch; when a handle 22 is depressed, a punch having the cross section of the slot 16 is pressed through the main tee web 12. An indexing arm 23 has a pin 24 that can be located in either a hole 18 or an oblong hole 17. The oblong hole 17, with the pin 24 at the end of the hole 17 adjacent the cross slot 16 positions the arm 23 and slot punch 21 at a nominal dimension, preferably an even two inches from the adjacent slot 16. When the indexing arm pin 24 is located in the round hole 18, the punch 21 is centered at another nominal even dimension such as three inches. Equivalent even metric dimensions can be, for instance, 5 cm and 8 cm. In the illustrated case, hole 18 is one inch from the far end of the adjacent oblong hole 17. Offsets between slots of two inches or three inches on both sides of an original factory slot 16 yield popular spacings of 4 and 6 inches for lighting and/or air ducts. The slot punch 21 can be provided with two arms 23 or can be positioned on both sides of a main tee 11 to produce holes 17, 18 symmetrically on both sides of a factory slot.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A main tee for a suspended ceiling formed of sheet metal and having an upper reinforcing bulb, a lower flange and a web between the upper reinforcing bulb and the lower flange, the web having evenly spaced, generally vertical cross tee receiving slots along a length of the main tee and a series of suspension wire receiving holes along the length of the main tee, the suspension wire receiving holes having lowermost edges and being spaced below the upper reinforcing bulb, the lowermost edges of the suspension wire receiving holes being above a highest extremity of the cross tee receiving slots, the suspension wire receiving holes being adjacent and symmetrically arranged about respective cross tee receiving slots, the suspension wire receiving holes including round holes on two sides of a respective cross tee receiving slot of the cross tee receiving slots remote from the respective cross tee receiving slot and oblong holes on both sides of the respective cross tee receiving slot adjacent the respective cross tee receiving slot.

2. The main tee as set forth in claim 1, wherein the oblong holes and the round holes have a same elevation above the lower flange.

3. The main tee as set forth in claim 1, wherein a spacing between adjacent round and oblong holes of the round and oblong holes is an even dimension.

4. The main tee as set forth in claim 1, wherein the oblong holes and the round holes are symmetrically disposed around the respective cross tee receiving slot and a distance between a respective one of the round holes and a cross tee receiving slot is less than a height of the main tee.

5. A main tee for use in a suspended ceiling grid formed of sheet metal and having an upper reinforcing bulb, a lower flange and a vertical web between the upper reinforcing bulb and the lower flange, the vertical web having a series of evenly spaced cross tee slots and a series of hanger wire holes spaced longitudinally from the cross tee slots and vertically from the upper reinforcing bulb, each of the cross tee slots having two sides, the hanger wire holes having lower edges above a height of the cross tee slots, the hanger wire holes including a pair of oblong holes, one of the pair of oblong holes on each side of and adjacent a respective cross tee slot of the cross tee slots, and a pair of round holes, each round hole of the pair of round holes being on a side of an oblong hole of the pair of oblong holes remote from a respective one of the cross tee slots.

* * * * *